US007543573B2

(12) United States Patent
Olree

(10) Patent No.: US 7,543,573 B2
(45) Date of Patent: Jun. 9, 2009

(54) FUEL RECOVERY SYSTEM FOR INTERNAL COMBUSTION ENGINES

(75) Inventor: Robert M. Olree, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 83 days.

(21) Appl. No.: 11/756,221

(22) Filed: May 31, 2007

(65) Prior Publication Data

US 2008/0295810 A1 Dec. 4, 2008

(51) Int. Cl.
*F02M 33/04* (2006.01)
*F02M 33/02* (2006.01)

(52) U.S. Cl. ..... 123/518; 123/519; 123/41.86

(58) Field of Classification Search ..... 123/518, 123/41.86, 516, 519, 520, 572–574
See application file for complete search history.

(56) References Cited

U.S. PATENT DOCUMENTS 3,675,634 A * 7/1972 Tatsutomi et al. ..... 123/519
4,515,137 A * 5/1985 Manolis ..... 123/572
4,630,575 A * 12/1986 Hatamura et al. ..... 123/184.48
5,542,401 A * 8/1996 Newarski ..... 123/572
5,586,996 A * 12/1996 Manookian, Jr. ..... 55/321
5,964,207 A * 10/1999 Clauss et al. ..... 123/572
5,992,397 A * 11/1999 Hideaki et al. ..... 123/538
6,418,917 B1 * 7/2002 Bistue ..... 123/572
6,575,145 B2 * 6/2003 Takahashi ..... 123/519
2002/0062819 A1 * 5/2002 Takahashi ..... 123/519
2004/0069286 A1 * 4/2004 Knowles ..... 123/572
2007/0028903 A1 * 2/2007 Bruchner et al. ..... 123/574

* cited by examiner

*Primary Examiner*—Mahmoud Gimie

(57) ABSTRACT

A recovery system for fuel for motor vehicles includes a canister having an absorbent media such as activated charcoal. The canister includes an inlet in fluid communication with the blow-by vent of an internal combustion engine and an outlet in communication with the air intake manifold of the engine. Control valves may be incorporated into the system to control fluid flows. As a single vaporization temperature fuel or fuel constituent such as ethanol that has mixed with engine oil during startup vaporizes when the oil reaches its vaporization temperature, it is first absorbed in the activated charcoal and then slowly released and burned in the engine. The system has particular applicability to E85 fueled vehicles.

20 Claims, 1 Drawing Sheet

FUEL RECOVERY SYSTEM FOR INTERNAL COMBUSTION ENGINES

BACKGROUND OF THE INVENTION

1. Field of the Invention

The invention relates generally to fuel recovery systems for internal combustion engines and more particularly to a recovery systems for the ethanol constituent of E85 fuel for use with internal combustion engines.

2. Description of the Prior Art

One of the very first sources of emissions targeted for reduction in internal combustion engines utilized in passenger cars and other motor vehicles was blow-by, i.e., air and unburned fuel that enters the crankcase and is emitted into the atmosphere by a breather vent in a valve cover.

Since the early 1960s, positive crankcase ventilation (PCV) systems have been utilized which collect and direct the unburned fuel to the carburetor or intake manifold where it is burned in the cylinders. These systems not only eliminated this source of pollution but also slightly improved fuel economy as they ensured that fuel that was previously lost by dispersal into the atmosphere was burned in the engine.

At normal engine operating temperatures, well above the volatilization temperatures of the various fractions of conventional hydrocarbon fuel, i.e., gasoline, fuel in the blow-by moves directly through the PCV system and there is no accumulation of fuel in the crankcase. However, at start-up and in low temperature operating conditions, the fuel will condense in the crankcase. As the engine warms up, this condensed fuel vaporizes and is swept through the PCV system. Because gasoline comprises many different hydrocarbon fractions that vaporize at different temperatures, this vaporization occurs gradually over a period of time.

Recently a low emission fuel manufactured from agricultural products, primarily corn, and designated E85 has become available for consumer use in passenger cars. The fuel is nominally 85% ethanol or grain alcohol. When an E85 fueled vehicle is started or operated in a low temperature environment, some of the ethanol enters the crankcase in liquid form and mixes with the engine lubricating oil. As the engine warms up and reaches 78 degrees Celsius (172.4 degrees Fahrenheit) all of the ethanol in the crankcase vaporizes and flows through the PCV system at a very high rate. Even though the oxygen sensor has shut off fuel flow to the cylinders, in extreme cases there may be so much vaporized ethanol flowing through the PCV system that the engine runs rich and exhaust emissions are increased. At the very least, this high momentary flow of vaporized ethanol through the PCV system and engine is difficult for the engine control system to compensate for. Additionally, this event may result in drivability issues.

From the foregoing, it is apparent that improvements in fuel systems for vehicles utilizing E85 as fuel are desirable.

SUMMARY OF THE INVENTION

A fuel recovery system for a single vaporization temperature fuel or fuel constituent such as ethanol of E85 fuel for motor vehicles includes a canister filled with an absorbent media such as activated charcoal. The canister includes an inlet in fluid communication with the crankcase blow-by vent of an internal combustion engine, an outlet in communication with the air intake manifold of the engine and a vent communicating with the atmosphere. Control valves may be incorporated into the system to control fluid flows. As ethanol that has been mixed with engine oil during startup and before the engine reaches operating temperature vaporizes when the oil reaches approximately 78 degrees Celsius, it is first absorbed in the activated charcoal and then slowly released and burned in the engine. The slow release and burning of the ethanol from the canister avoids a brief transient condition that may interfere with engine operation and increase emissions. A passive fuel recovery system is also disclosed.

Thus it is an object of the present invention to provide an apparatus for temporarily absorbing fuel such as ethanol from crankcase blow-by of an internal combustion engine.

It is a further object of the present invention to provide an apparatus for absorbing fuel such as ethanol from a crankcase of an internal combustion engine having a canister communicating with the blow-by vent of the engine and its intake manifold.

It is a still further object of the present invention to provide an apparatus for absorbing fuel such as ethanol from blow-by from a crankcase of an internal combustion engine and providing it to the engine intake manifold over a period of time.

It is a still further object of the present invention to provide an apparatus for temporarily absorbing fuel such as ethanol from blow-by from an internal combustion engine having a canister containing activated charcoal.

Further objects and advantages of the present invention will become apparent by reference to the following description and appended drawings wherein like reference numbers refer to the same component, element or feature.

DESCRIPTION OF THE PREFERRED EMBODIMENTS

Figure 1:
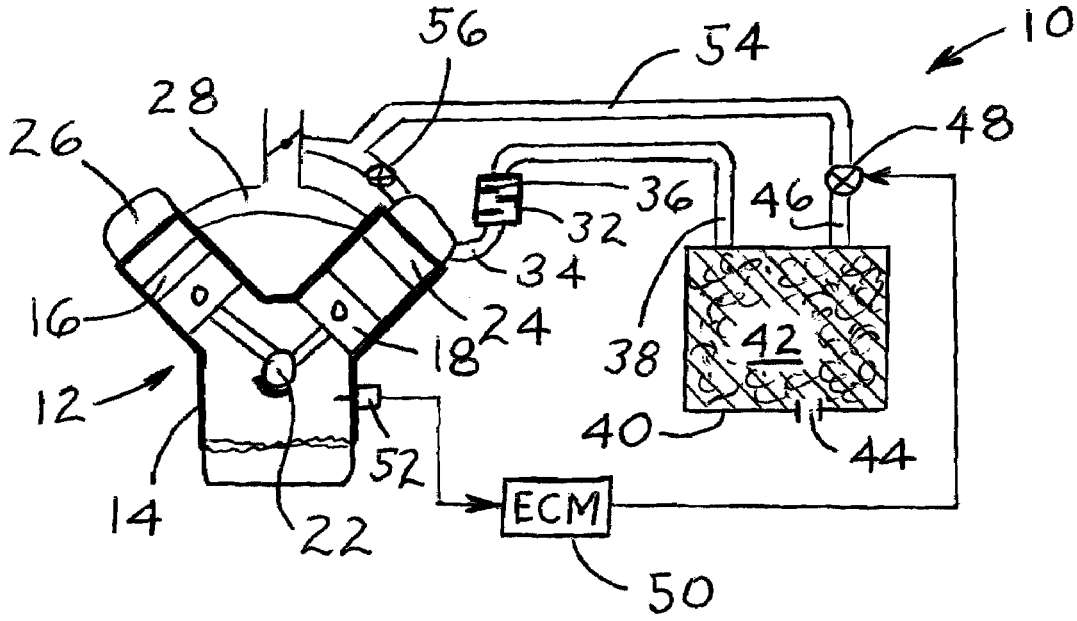
FIG. 1 is a diagrammatic view of a first embodiment of an E85 ethanol or fuel recovery system associated with an internal combustion engine.

Referring now to FIG. 1, a fuel recovery system for an internal combustion engine is illustrated and designated by the reference number 10. The system 10 is connected to and utilized in conjunction with an internal combustion engine 12 having an engine block 14 defining a plurality of cylinders 16, a like plurality of pistons 18 connected to a crankshaft 22, one or two cylinder heads 24, one or more valve covers 26 and an intake manifold 28.

The fuel recovery system 10 includes an oil separator 32 which may be connected to the interior of one or both of the valve covers 26 by a conduit, pipe or hose 34. The oil separator 32 includes baffles 36 or other flow interrupting or redirecting structures which collect oil mist or droplets which have been carried by the blow-by flow from within the valve covers 26. By virtue of its location above the valve covers 26, oil that collects in the oil separator 32 flows back into the valve covers 26 and the engine 12 by gravity.

A second conduit, pipe or hose 38 provides a fluid pathway between the oil separator 32 and a recovery canister 40. The recovery canister 40 may be any convenient regular or irregular shape such as cylindrical or rectangular and may be fabricated of, for example, a rugged plastic such as acrylonitrile-butadiene-styrene (ABS). The canister 40 is filled with an absorbent of E85 such as activated charcoal 42 or other suitable media. Preferably at the bottom of the canister 40 or, in any event, opposite the second, inlet pipe or hose 38 is an orifice or vent 44 which communicates with the atmosphere.

A third conduit, pipe or hose 46 communicates between the interior of the canister 40 and a solenoid control valve 48. The control valve 48 is opened and closed by signals emanating from an engine control module 50. The engine control module 50 is typically a microprocessor which includes inputs for signals from various engine and vehicle sensors (not illustrated) and controls various operating conditions and parameters of the engine 12. For example, an engine temperature sensor 52 may be utilized to provide a data signal to the engine control module 50 regarding the current temperature of the engine 12.

A fourth conduit, pipe or hose 54 provides a fluid pathway between the control valve 48 and the intake manifold 28. A flow controller 56 which may be either an orifice having a predetermined size and thus flow rate or a second solenoid control valve controls flow from the fourth pipe or hose 54 to the interior of the valve covers 26 of the engine 12.

The operation of the fuel recovery system 10 will now be described. For this description, it will be assumed that the engine 12 is fueled with E85 and is cold and at an ambient temperature which typically will be in the range of 20 degrees to 70 degrees Fahrenheit. Of course, depending upon the climate and season, temperatures may readily be encountered that are outside this range, sometimes substantially. When started in this condition, an engine 12 utilizing E85 fuel will experience blow-by of the fuel into the crankcase 22 and mixing of the E85 fuel and particularly the ethanol with the engine oil. The solenoid control valve 48 will preferably be closed at this time and the flow controller 56, if it is a valve, will be open. This situation will continue until the engine 12 and, more specifically, the oil have reached a temperature of 78 degrees Celsius (172.4 degrees Fahrenheit).

At this point, the ethanol will begin to vaporize rapidly and blow-by containing ethanol will exit the valve covers 26, enter the oil separator 32 where oil is removed from the blow-by and returned to the engine 12 and enter the recovery canister 40 where the ethanol is absorbed in the activated charcoal 42. The vent 44 in the canister 40 allows flow of ethanol and air into the canister 40 from the valve covers 26 and exhaust of cleansed air into the atmosphere. Rather quickly, all of the ethanol will vaporize and be absorbed by the activated charcoal 42, as described.

The engine operating temperature and the temperature of the engine oil will continue to rise. At a temperature well above 78 degrees Celsius, for example, 95 to 100 degrees Celsius (203 to 212 degrees Fahrenheit)or higher, the engine control module 50 or other controller will issue a command to open the solenoid control valve 48 and, if the flow controller 56 is a solenoid valve, issue a command to close it. In this operating condition, the partial vacuum in the intake manifold 28 will draw atmospheric air in through the vent 44 of the canister 40 which will absorb and carry with it ethanol from the activated charcoal 42. This air and ethanol will then flow through the fourth pipe or hose 54, be drawn into the intake manifold 28 and the cylinders 16 and be burned.

Over a period of time of normal driving, substantially all of the ethanol will be purged from the canister 40. Thus, E85 or any other fuel having substantially a single vaporization temperature, will be absorbed in the activated charcoal 42 and then slowly returned or metered into the blow-by flow to the intake manifold 28 and the cylinders 16 where it is burned.

After an additional period of time, the solenoid control valve 48 may be closed and the flow controller 56 may be opened if it is a valve to allow blow-by from the engine 12 to flow directly from the valve covers 26 to the intake manifold 28 in accordance with conventional positive crankcase ventilation practice.

Figure 2:
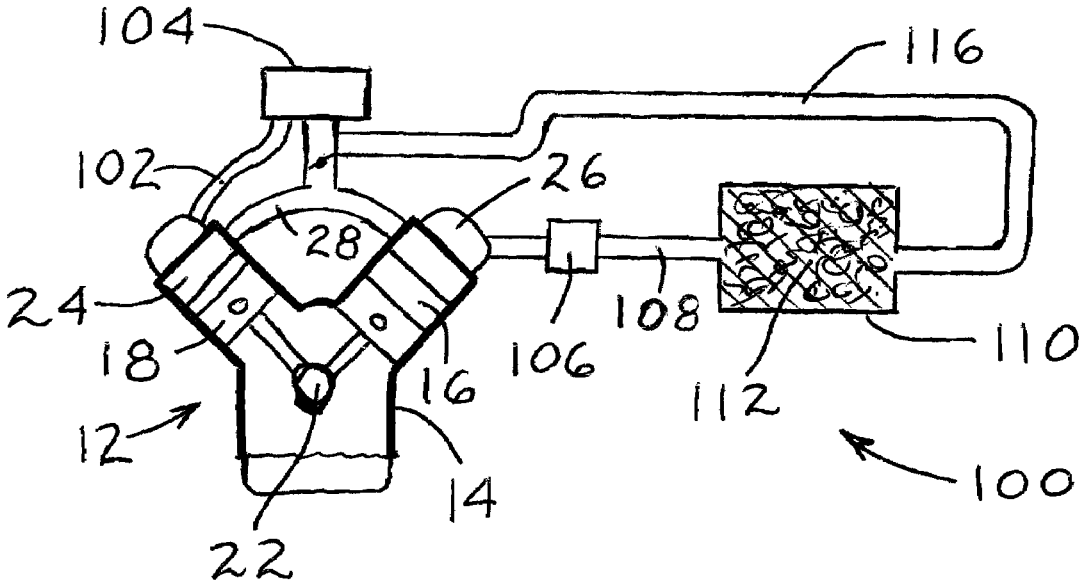
FIG. 2 is a diagrammatic view of a second embodiment of an E85 ethanol or fuel recovery system associated with an internal combustion engine.

Referring now to FIG. 2, a second embodiment of the fuel recovery system according to the present invention is illustrated and designated by the reference number 100. The system 100 is quite similar to the first embodiment system 10 and is typically utilized with an internal combustion engine 12 having components as listed and described in FIG. 1. Such description will therefore not be repeated. The system 100 may be fairly described as passive in that it includes a fresh air intake line 102 which communicates with a source of fresh air such as an air inlet duct 104 and the interior of the valve covers 26. A positive crankcase ventilation (PCV) valve 106 in another one of the valve covers 26 feeds an outlet line or hose 108 which extends between the other one of the valve covers 26 (or the opposite end of the valve cover 26 if there is only one) and a canister 110 containing activated charcoal 112. From the canister 110, a return line or hose 116 extends to the intake manifold 28.

The passive fuel recovery system 100 essentially operates continuously in the positive crankcase ventilation circuit of the engine 12. As such, blow-by from the engine 12 constantly circulates through the line 106 and the activated charcoal 112 in the canister 110, the flow being established by the partial vacuum in the intake manifold 28 and supplied by the fresh air inlet line 102.

During warm up of the engine 12 utilizing E85 or other fuel having substantially a single vaporization temperature, the relatively sudden and significant flow of, for example, ethanol, will be absorbed in the activated charcoal 112 and then slowly returned or metered to the blow-by flow in the return line 116 to the intake manifold 28 and burned in the cylinders 16 of the engine 12.

The description of the invention is merely exemplary in nature and variations that do not depart from the gist of the invention are intended to be within the scope of the invention. Such variations are not to be regarded as a departure from the spirit and scope of the invention.

I claim:

1. A fuel recovery system comprising, in combination, a canister containing fuel absorbent media, a first fluid line for receiving blow-by from an engine and providing it to said canister, a second fluid line for receiving fluid flow from said canister and providing it to an intake manifold of said engine, and a control valve in said second fluid line disposed between said canister and said intake manifold of said engine.

2. The fuel recovery system of claim 1 further including a flow controller in a third fluid line communicating between said second fluid line and an interior of valve cover of said engine.

3. The fuel recovery system of claim 2 wherein said flow controller is an orifice.

4. The fuel recovery system of claim 2 wherein said flow controller is a second control valve.

5. The fuel recovery system of claim 1 further including an oil separator disposed in said first fluid line.

6. The fuel recovery system of claim 1 wherein said fluid canister includes an inlet connected to said first fluid line and an outlet connected to said second fluid line and a vent to atmosphere.

7. The fuel recovery system of claim 1 wherein said fuel absorbent media is activated charcoal.

8. The fuel recovery system of claim 1 further including an engine temperature sensor and an engine control module for receiving a signal from said engine temperature sensor and controlling said control valve.

9. A system for recovering and supplying ethanol fuel to an engine comprising, in combination, a canister containing a media for recovering ethanol fuel, a flow pathway connecting a source of engine blow-by with said canister, a second flow pathway connecting said canister with an intake manifold of an engine, and a control valve in said second flow pathway disposed between said canister and said intake manifold of said engine.

10. The system of claim 9 further including a oil separator in said first flow pathway.

11. The system of claim 9 further including a flow controller in a third fluid pathway between said second fluid pathway and a valve cover of said engine.

12. The system of claim 11 wherein said fluid controller is a second control valve.

13. The system of claim 11 wherein said fluid controller is an orifice.

14. The system of claim 9 wherein said media is activated charcoal.

15. The system of claim 9 further including an engine temperature sensor and an engine control module for receiving a signal from said engine temperature sensor and controlling said control valve.

16. The process of recovering and supplying fuel to an engine comprising the steps of:

providing a canister having a fuel absorbent, providing blow-by from the engine to said canister as fuel is vaporized from the engine, temporarily storing the fuel in the fuel absorbent; and providing through a control valve a reduced flow of fuel from said absorbent to an intake manifold of the engine, whereby operation of the engine is improved by reducing the maximum delivery rate of said vaporized fuel provided to the engine.

17. The process of claim 16 further including the step of separating oil from the blow-by before providing it to said canister.

18. The process of claim 16 wherein said fuel absorbent is activated charcoal.

19. The process of claim 16 further including the step of controlling the flow from said absorbent to said intake manifold.

20. The process of claim 16 further including the step of providing a restricted flow path between said intake manifold and an interior of a valve cover of the engine.

* * * * *